United States Patent [19]

Peake

[11] 4,045,087

[45] Aug. 30, 1977

[54] MINING APPARATUS

[76] Inventor: Cecil Vowe Peake, 2424 Blake Court, Bethlehem, Pa. 18017

[21] Appl. No.: 611,409

[22] Filed: Sept. 8, 1975

[30] Foreign Application Priority Data

Sept. 7, 1974 United Kingdom ..... 39148/74

[51] Int. Cl.[2] ..... E21D 15/502

[52] U.S. Cl. ..... 299/31; 61/450; 299/33; 299/43

[58] Field of Search ..... 299/31, 33, 43; 61/45 D

[56] References Cited

U.S. PATENT DOCUMENTS

| | | | |
|---|---|---|---|
| 3,355,213 | 11/1967 | Seddon | 61/45 D |
| 3,445,139 | 5/1969 | Von Hippel | 299/43 |
| 3,739,586 | 6/1973 | Wehner | 61/45 D |
| 3,779,023 | 12/1973 | Koppers | 61/45 D |
| 3,891,275 | 6/1975 | Spies | 299/33 X |
| 3,902,325 | 9/1975 | Sigoh | 61/45 D |

FOREIGN PATENT DOCUMENTS

| | | | |
|---|---|---|---|
| 1,482,298 | 2/1967 | France | 61/45 D |
| 1,143,771 | 2/1963 | Germany | 61/45 D |
| 959,879 | 6/1964 | United Kingdom | 299/43 |
| 250,080 | 6/1970 | U.S.S.R. | 299/43 |

*Primary Examiner*—Ernest R. Purser
*Assistant Examiner*—William F. Pate, III
*Attorney, Agent, or Firm*—Michael J. Striker

[57] ABSTRACT

Mining apparatus for longwall mining comprising a mineral winning machine which traverses a mineral face, a row of self-advanceable roof supports parallel to the face, and a conveyor also parallel to the face for removing cut mineral, the supports having platforms which support the conveyor, the hydraulic props of the supports being positioned between the mineral face and the conveyor. The winning machine thereby can cut substantially across its whole depth, the props being adjacent the face to be cut. Ramps are provided on the supports and the conveyor to scoop out mineral onto the platforms and then on the conveyor, during advance of the supports and the conveyor.

6 Claims, 2 Drawing Figures

MINING APPARATUS

Figure 1:
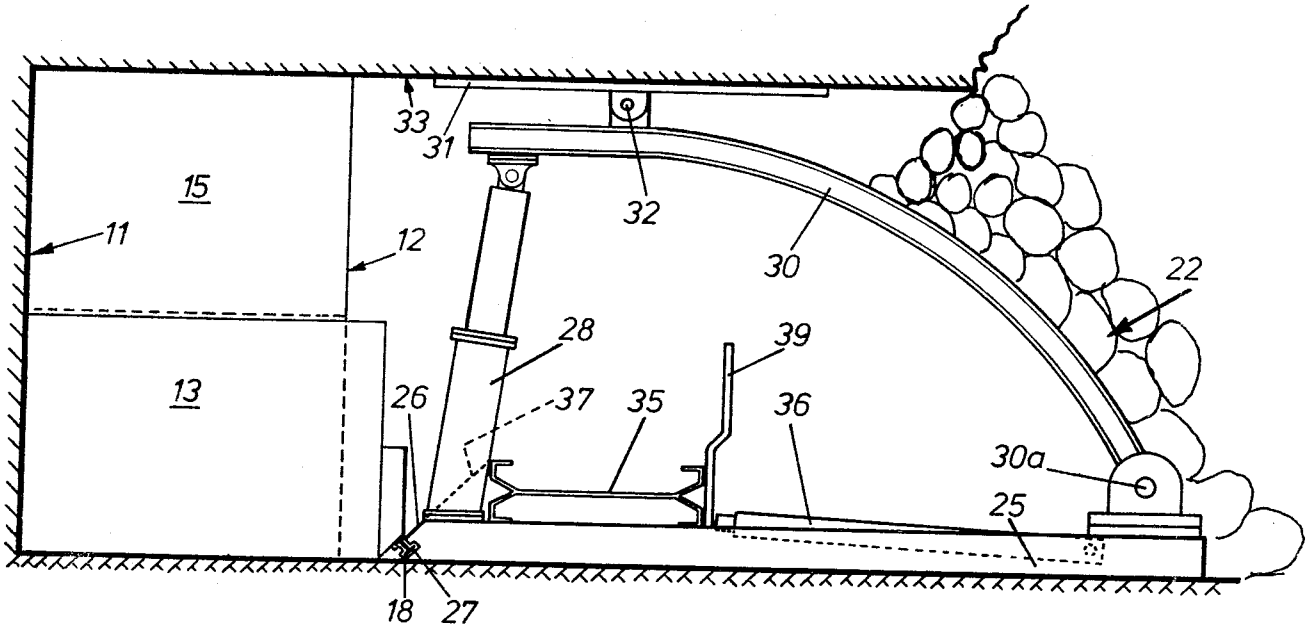

This invention relates to mining apparatus and is particularly concerned with coal mining.

Longwall mining techniques are well known, wherein a cutting machine is traversed back and forth along a coal face, cutting off a layer, during each traverse, of a given depth. A conveyor is provided to convey the cut coal from the face and as the face recedes, the conveyor is advanced. It is necessary to support the roof of the mine near to the face to prevent collapse and hydraulic supports are used which are also advanced as the coal face recedes. The supports are connected to the conveyor, which lies between the face and the supports, by a hydraulic ram to effect advancement of the conveyor whilst the support is held by the support props and also to effect self-advancement with the props released and the conveyor held in position. The coal cutting machine rides on top of the conveyor. It is essential, for safety reasons, that the roof is supported quite close to the face and the maximum distance is regulated in the United Kingdom. A limited space remains, therefore, between the supports and the face to accommodate the cutting machine and the conveyor and any reduction in the width occupied by these devices enables a greater depth of coal to be dut during each traverse of the machine. One object of the present invention is to provide mining apparatus which permits a greater depth of a mineral, such as coal, to be cut from a mineral face during a single traverse of a cutting machine along the face.

The present invention resides in mining apparatus comprising a mineral cutting machine arranged to traverse along a mineral face, a plurality of self-advanceable roof supports arranged side by side along the face, and a conveyor carried by the supports and connected with advance cylinders thereof, support props of the supports being located between the cutting machine and the conveyor. Preferably, ramp means is provided so that as a support is advanced the mineral rides up the ramp plate to be deposited on the conveyor. Hence, the conveyor and its ancillary equipment, such as means for preventing spillage, do not determine the width of the space between the supports and the face. The mineral cutting machine is preferably constructed and arranged with its body substantially between the width of the cutting head of the machine, so that almost the total width of the machine is recessed into the face during cutting. Only a very small gap is left, therefore, between the face and the supports.

Preferably, each support includes guide means for receiving a complementary part of the mineral cutting machine for guiding the latter along the mineral face, during haulage of the machine.

The invention additionally resides in a self-advanceable hydraulic roof support for use in cutting a mineral from a longwall face, the support including a hydraulic roof support prop and a hydraulic advance cylinder and being provided with a flat surface on the goaf side of the prop for supporting a face conveyor, the advance cylinder being arranged for connection to a conveyor mounted on said flat surface.

Reference is now made to the accompanying drawings, wherein

Figure 2:
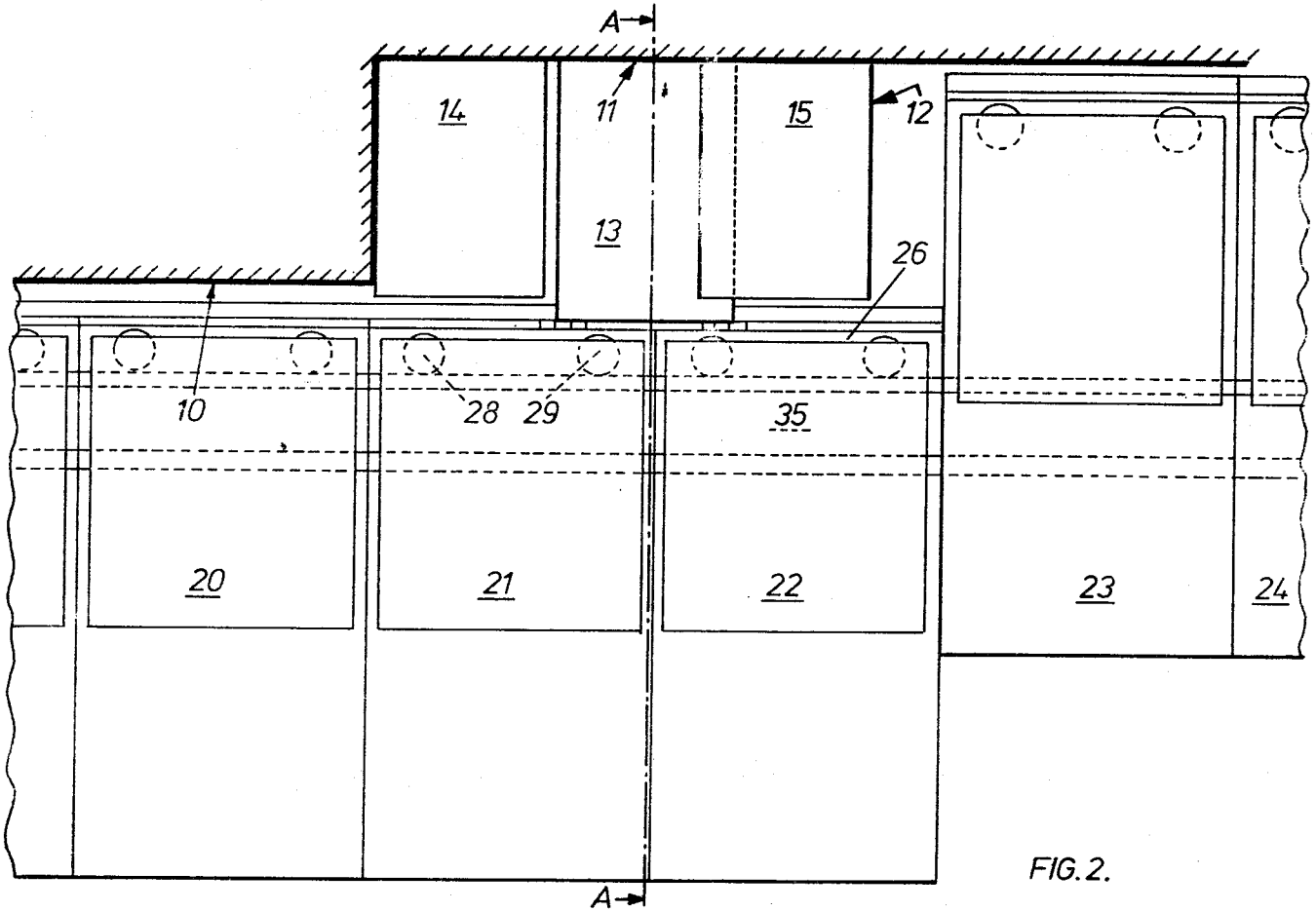

FIG. 1 is a diagrammatic part-sectional view of coal mining apparatus according to the invention taken on the line A—A of FIG. 2; and FIG. 2 is a plan view of the apparatus.

Referring to the drawings, there is shown a coal face 10 (FIG. 2) having a recess with a back face 11. In the recess is provided a cutting machine 12 which is shown moving to the left, as shown in FIG. 2, so that the recess is becoming enlarged in length. At the end of the traverse to the left, the back face 11 will, therefore, form a new face 10 for the return traverse. The machine 12 has a body 13 and is provided with forward and rearward cutting heads 14, 15, for cutting coal during the left traverse and a right traverse respectively of the machine. The body has substantially the same width as the cutting heads, but projects slightly beyond the face 10 where the body carries a guide shoe or shoes 18 (FIG. 1) and a machine haulage device. The haulage device may be that conventionally used in longwall mining, wherein the machine hauls itself along a taut chain, or the machine may run on a rack attached to the roof supports such as 20 to 24 described hereafter. The first such drive system is shown in FIG. 1 of U.K. patent specification No. 995,210 and an example of the second type is fully described in U.K. patent specification No. 1,265,171.

Said hydraulic roof supports 20 to 24 are self-advanceable and are provided at intervals along the face 10. As shown in FIG. 2, two of these supports 23, 24 have been advanced behind the cutting machine to be adjacent the back face 11. Each support is an adapted form of the well known shield type known as a Hemscheidt shield support, type 72 sold by Hermann Hemscheidt of 5600 Wuppertal-Eberfeld, Bornberg 97-103, West Germany. Each support comprises a base 25 provided with a forward ramp plate 26. The ramp plate incorporates a guide rail 27, which is complementary to and receives the shoe 18 to guide the cutting machine during its traverse. Adjacent the ramp plate, the base carries a pair of hydraulic props 28, 29. A plate-like shield 30 of arcuate form in this embodiment defines an arm, which is pivoted to the base at **30*a* at the rear end of the base, about a horizontal axis. The shield extends forwardly over the support and is supported by the hydraulic props 28, 29. The shield pivotally carries a support plate (or top canopy) 31 mounted about an axis 32 for angular movement of the plate to follow the angle of the roof 33. A face conveyor 35 of conventional design is mounted along the coal face and is carried on the bases 25 of the supports. The conveyor carries spill plates 39. The base houses an advance ram 36 which is connected to the conveyor. The conveyor carries a ramp plate 37, which forms a continuation of the ramp plate 26 on the base, with the conveyor and the support 22 in the relative positions shown in FIG. 1.**

In use, the supports are individually advanced in conventional manner behind the cutting machine, by releasing the pressure on the hydraulic props of the support to be moved and contracting the advance ram 36. The conveyor is held stationary by the other props to permit the advancement. The conveyor is later drawn back to the relative position with respect to the support, as shown in FIG. 1, by extension of the ram with the pressure returned to the hydraulic props.

The cut coal will fall onto the floor behind the cutting machine and is transferred to the conveyor by the actions of advancement. During advancement of a support, the base ramp plate 26 picks up coal from the plate and deposits it on top of the base 25. During advancement of the conveyor, this coal is transferred by the ramp plate 37 onto the conveyor.

The arrangement described enables the roof to be supported very close to the coal face with the possibility of a considerable increase in the depth of coal which can be cut as compared with the conventional arrangement. In addition, the distance between the face and the rear of the support plate 31 is arranged to be not more than twice the depth of cut (i.e. the depth of the recess). In the example shown, this ratio is considerably less than 2:1. The roof 33 is substantially stressed by the supports only once with small areas being stressed twice. Consequently, the roof is less liable to collapse than with conventional arrangements wherein the roof is stressed several times due to providing large support plates extending from the support props towards the face and overlying the face conveyor.

In view of the supporting of the conveyor on the supports, undulations and snaking of the conveyor are substantially unnecessary, as they are in conventional systems to provide for an uneven floor and advancement of the conveyor together with the support. The conveyor can be of simpler construction, therefore, by reducing the articulation between sections and, in addition, a flat strand chain can be used for driving the conveyor, instead of a cable chain, which is used for driving the conveyor, instead of a cable chain, which is used at present, with accompanying greater strength or possibly a reduction in dimension of the chain for the same strength.

It will be appreciated that the support need not be of the type described and it is envisaged, for example, that the support could be of the type known as a four-leg-chock-shield support, such supports being made by Dowty Mining Co. Ltd. of England and Westphalia Lunen A.G. West Germany.

I claim:

1. Longwall mining apparatus comprising a mineral cutting machine arranged to traverse back and forth along a mineral face; and a plurality of self-advanceable roof supports arranged side by side along said mineral face, each of said supports comprising a base having a flat top portion adapted to support a face conveyor, said base having a front end and a rear end, an inclined plate-like shield having a lower end and an upper end, at least one substantially upright hydraulic prop adapted to be extended and retracted and mounted on the base adjacent said front end of the latter, first hinge means connecting said lower end of said shield to said base and second hinge means connecting said upper end of said shield to the upper end of said hydraulic prop, a roof support platen connected to said shield upwardly spaced therefrom, an extendable and retractable advance hydraulic cylinder mounted on said base and connected to said face conveyor, said face conveyor being located between said hydraulic prop and said hydraulic cylinder, guide means located on the face side of said hydraulic prop and adapted to guide a mineral cutting machine in its traverse along said mineral face, a ramp plate on said front end of said base adapted to scoop cut mineral onto said flat top portion of said base as said roof support is advanced towards said mineral face relative to said conveyor by operation of said hydraulic cylinder.

2. Longwall mining apparatus according to claim 1, including guide means and shoe means complementary to and engaged with the guide means and the shoe means being provided one on the roof supports and the other on the cutting machine.

3. Longwall mining apparatus according to claim 1, wherein the ratio of the distance between the mineral face and the rear side of the roof support means to the depth of cut of the cutting machine is not substantially more than 2:1.

4. Longwall mining apparatus according to claim 1, and including means located rearwardly of said upper end of said shield for pivotally connecting said platen to said shield, said platen extending to opposite sides of said pivot means.

5. Longwall mining apparatus according to claim 1, including a further ramp at the face of said conveyor adapted to scoop cut mineral from said base onto said conveyor as said conveyor is advanced relative to said support by operation of said advance hydraulic cylinder.

6. A hydraulic roof support adapted for use in cutting a mineral from a longwall face, comprising a base having a flat top portion adapted to support a face conveyer, said base having a front end and a rear end, an inclined plate-like shield having a lower end and an upper end, at least one substantially upright hydraulic prop adapted to be extended and retracted and mounted on the base adjacent said front end of the latter, first hinge means connecting said lower end of said shield to said base and second hinge means connecting said upper end of said shield to the upper end of said hydraulic prop, a roof support platen connected to said shield upwardly spaced therefrom, an extendable and retractable advance hydraulic cylinder mounted on said base and connected to said face conveyer, said face conveyer being located between said hydraulic prop and said advance hydraulic cylinder, guide means located on the face side of said hydraulic prop and adapted to guide a mineral cutting machine in its traverse along said mineral face, a ramp plate on said front end of said base adapted to scoop cut mineral onto said flat top portion of said base as said roof support is advanced relative to said conveyer by operation of said advance hydraulic cylinder.

* * * * *